United States Patent [19]

Otsuka

[11] Patent Number: 4,956,671

[45] Date of Patent: Sep. 11, 1990

[54] WIRE CLEANING DEVICE FOR A CORONA DISCHARGE TYPE CHARGER

[75] Inventor: Hirohisa Otsuka, Kawaguchi, Japan

[73] Assignee: Ricoh Company, Ltd., Tokyo, Japan

[21] Appl. No.: 263,361

[22] Filed: Oct. 27, 1988

[30] Foreign Application Priority Data

Oct. 29, 1987 [JP] Japan ..... 62-271769

[51] Int. Cl.[5] ..... G03G 21/00; G03G 15/02

[52] U.S. Cl. ..... 355/215; 250/324; 355/221

[58] Field of Search ..... 355/215, 220, 219, 221; 250/324, 325, 326

[56] References Cited

U.S. PATENT DOCUMENTS 4,788,573 11/1988 Nakaoka et al. ..... 355/215

FOREIGN PATENT DOCUMENTS 54-51851 4/1979 Japan ..... 355/221
54-104833 8/1979 Japan ..... 355/221
54-116938 9/1979 Japan ..... 355/221
54-146635 11/1979 Japan ..... 355/221
58-163964 9/1983 Japan ..... 355/221

*Primary Examiner*—Fred L. Braun
*Attorney, Agent, or Firm*—Oblon, Spivak, McClelland, Maier & Neustadt

[57] ABSTRACT

A device for cleaning a wire of a corona discharge type charger installed in an electrophotographic copier or similar image recording apparatus such as a charger for charging a photoconductive element, a transfer charger or a separation charger. The device includes a pair of cleaning pads which clean the wire by individually holding diametrically opposite portions of the periphery of the wire, i.e. a portion which faces the surface of the photoconductive element to be charged and a portion which is remote from the surface of the same element. The cleaning pads act on the wire only when the pads and the wire are moved in one predetermined direction relative to each other.

4 Claims, 5 Drawing Sheets

WIRE CLEANING DEVICE FOR A CORONA DISCHARGE TYPE CHARGER

BACKGROUND OF THE INVENTION

1. Field of the Invention

The present invention relates to a wire cleaning device for a corona discharge type charger installed in an image recording apparatus and, more particularly to a wire cleaning device for a corona discharge type charger such as a charger for charging a photoconductive element, a transfer charger or a separation charger which is built in an electrophotographic copier, for example.

2. Discussion of the Background

An electrophotographic copier or similar image recording apparatus which is implemented by an electrostatographic process includes a photoconductive element. Arranged around the photoconductive element are various process units including a charger for charging the surface of the photoconductive element, optics for forming a document image on the charged surface of the photoconductive element, a developing unit for developing the image on the photoconductive element by toner or similar developer, a transfer charger for transferring the resulting toner image to a paper, a separation charger for separating the paper from the photoconductive element after the image transfer, and a cleaning unit for removing toner particles remaining on the photoconductive element after the image transfer. Among such units, the chargers adapted to charge the photoconductive element are in many cases implemented by corona discharge type chargers. This type of charger is usually comprised of a shield case having an opening which extends over substantially the entire length of the surface of the photoconductive element which is to be charged, end blocks made of a dielectric material and positioned at opposite ends of the shield case, and a wire extending between the end blocks.

A problem with a charger of the type described is that its wire is often stained with grease of an operator's hands during assembly and/or gathers impurities such as toner particles, dust particles and moisture floating in the copier during copying operation. Such impurities deposited on the wire would lower the discharging efficiency of the charger and bring about irregular discharging, thereby degrading the quality of reproduction. Such an occurrence has to be eliminated by cleaning the wire occasionally. There has been proposed a wire cleaning device having cleaning members in the form of cleaner pads which are made of urethane foam or similar soft material, and a support member which is made of polycarbonate or similar insulating material for supporting the cleaner pads. To clean the wire, the support member is slidingly moved along the shield case of the charger so that impurities deposited on the wire may be removed by friction. More specifically, two cleaner pads are mounted on a support member such that they extend parallel to each other at opposite sides of the wire and in a plane perpendicular to the plane which faces the surface of the photoconductive element. In the event of cleaning, the cleaner pads are caused to slide on the wire while sandwiching the latter from opposite sides. A drawback with such a configuration is that although the impurities present in those portions of the wire on which the cleaner pads act may be removed, the impurities deposited in the portion of the wire which faces the photoconductive element and the portion which is diametrically opposite thereto cannot be removed because the friction pads do not act thereon at all. The wire therefore cannot be sufficiently cleaned of impurities and suffers from a considerable decrease in charging efficiency and irregular charging.

Another approach proposed in the light of the above noted information is to hold a single cleaner pad in contact with that portion of the wire which faces the surface of the photoconductive element to be charged, as disclosed in Japanese Laid-Open Utility Model Publication (Kokai) No. 58-146246. Such an approach, however, brings about another drawback that the wire yields during cleaning because the cleaner pad contacts the wire from one side only. Again, this prevents impurities from being sufficiently removed from the wire.

Each of the prior art cleaning devices discussed above are usually securely mounted on a body of a copier or similar image recording apparatus. Every time a charger is moved into and out of the apparatus body, the cleaner pad or pads act on the wire of the charger to remove impurities from the wire based on such movements of the charger. This is undesirable because impurities collected by the cleaner pads when the charger was pulled out of the apparatus body are apt to be deposited again on the wire when the charger is pushed into the apparatus body.

SUMMARY OF THE INVENTION

It is therefore an object of the present invention to provide a wire cleaning device for a charger of an image recording appartatus which reliably removes impurities from a wire of the charger.

It is another object of the present invention to provide a wire cleaning device for an image recording apparatus which reliably cleans that part of a wire which faces the surface of a photoconductive element.

It is another object of the present invention to provide a wire cleaning device for an image recording apparatus which prevents impurities removed from a wire being transfered again to the wire.

It is another object of the present invention to provide a generally improved wire cleaning device for a corona discharge type charger.

In accordance with the present invention, in a device for cleaning a wire of a charger having a shield case formed with an opening which faces a surface of a photoconductive element of an image recording apparatus to be charged and extends over substantially the entire length of the surface of the photoconductive element, and a wire extending within and in a lengthwise direction of the shield case, cleaning members are movable into and out of contact with a portion of the wire which faces the surface of the photoconductive element and a portion which is diametrically opposite to the first-mentioned portion repectively, and are movable relative to the wire.

BRIEF DECRIPTION OF THE DRAWINGS

The above and other objects, features and advantages of the present invention will become more apparent from the following detailed description taken with the accompanying drawings in which.

DESCRIPTION OF THE PREFERERED EMBODIMENT

To better understand the present invention, a brief reference will be made to a prior art wire cleaning device for a charger of the type described.

Figure 1:
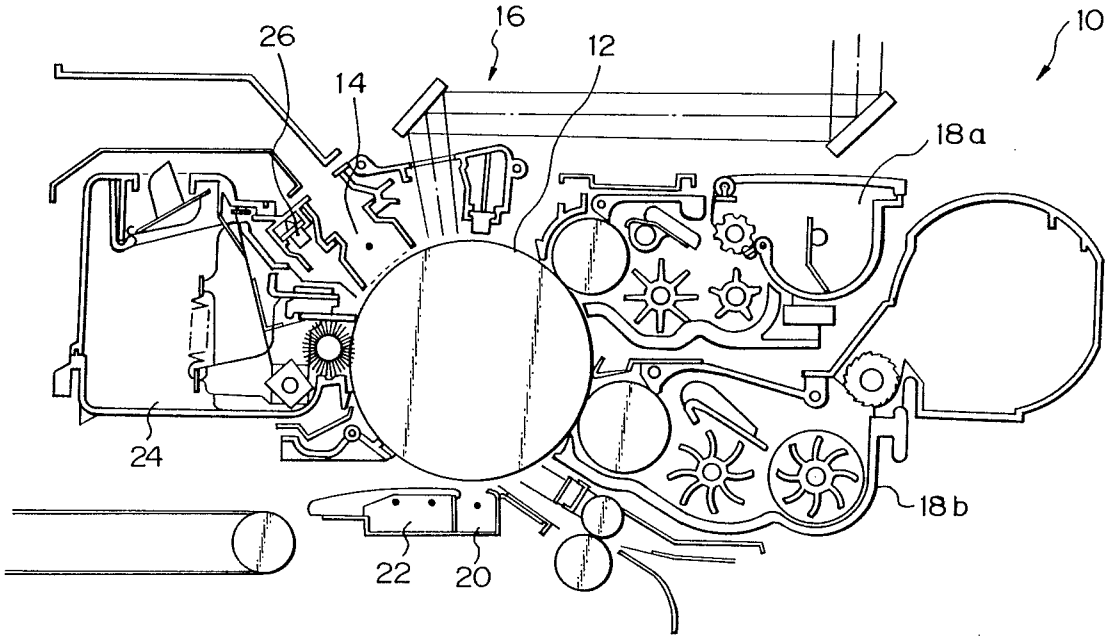
FIG. 1 is a section showing a photoconductive element of an electrophotographic copier which is representative of a family of image recording apparatuses together with various units arranged around the photoconductive element.
Figure 2:
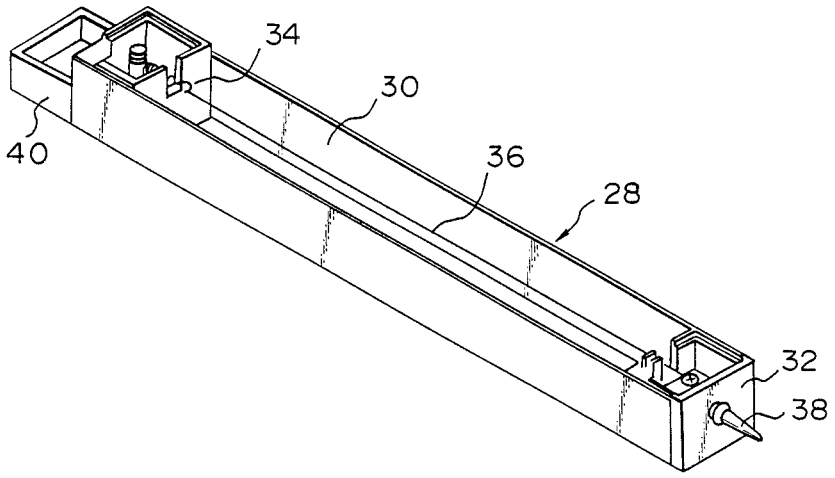
FIG. 2 is a perspective view of the specific construction of a charger which is installed in the copier of FIG. 1.

Referring to FIG. 1, an ordinary electrophotographic copier implemented by an electrostatographic process is shown and generally designated by the reference numeral 10. As shown, the copier 10 includes a photoconductive element 12 and various process units arranged around the photoconductive element 12, i.e., a charger 14 for charging the surface of the element 12, optics 16 for exposing the element 12 to imagewise light, developing units 18*a* and 18*b*, a transfer charger 20, a separation charger 22, a cleaning unit 24, and a lamp 26 for discharging. The chargers 14, 20 and 22 are often implemented by a corona discharge type charger. FIG. 2 shows a scorotron charger 28 representative of a family of corona discharge type chargers. In the figure, the scorotron charger 28 includes a shield case 30 having an opening which extends over substantially the entire length of the surface of the photoconductive element 12 which is to be charged, end blocks 32 and 34 delimiting the lengthwise extension of the shield case 30 and each being made of a dielectric material, a wire 36 extending between the end blocks 32 and 34, a feed terminal 38, and a grip 40 accessible for mounting and dismounting the charger 28 from the copier body. Further, the scorotron charger 28 may be provided with a screen-like grid (not shown) in the opening of the shield case 30 for the purpose of promoting quality reproduction. An adequate voltage is applied to such a screen-like grid to control the discharge potential and thereby the surface potential of the photoconductive element 12 to a predetermined value.

Figure 3:
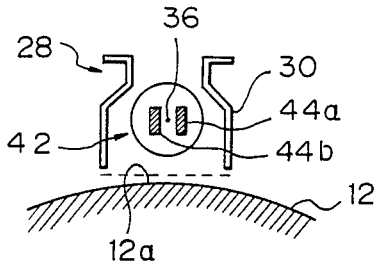
Fig. 3 PRIOR ART
FIG. 3 is a schematic view showing a prior art wire cleaning device for a charger.
Figure 4:
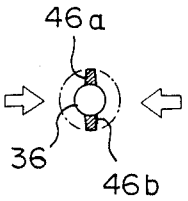
Fig. 4 PRIOR ART
FIG. 4 is a schematic enlarged view associated with FIG. 3.

In the above-described type of charger, the wire is apt to be stained with grease of an operator's hands during assembly and/or gathers toner particles, dust particles and moisture floating in the copier during copying operation. Hence, at least the wire of the charger has to be cleaned of such impurities occasionally. FIG. 3 shows an implementation heretofore proposed for cleaning the wire. In FIG. 3, the wire cleaning device 42 comprises a pair of cleaner pads 44*a* and 44*b* made of urethane form or similar soft material and positioned at opposite sides of the wire 36 and parallel to each other in a plane which is perpendicular to the plane which faces the surface 12*a* of the photoconductive element 12 to be charged. The cleaner pads or cleaning members 44*a* and 44*b* are caused to slide on and along the wire 36 while holding the latter therebetween. As shown in an enlarged scale in FIG. 4, the cleaning members 44*a* and 44*b* cannot remove impurities 46*a* and 47*b* deposited in that part of the wire 36 which faces the surface 12*a* of the photoconductive element 12 as well as in the part which is diametrically opposite to the first-mentioned part although they may successfully clean the other parts of the wire 36 on which they act as indicated by arrows.

Referring to FIGS. 5 to 11, a wire charging device embodying the present invention is shown which is free from the drawback particular to the prior art as discussed above. In the figures, the same or similar structural elements as those shown in FIGS. 1 to 4 are designated by like reference numerals.

Figure 5:
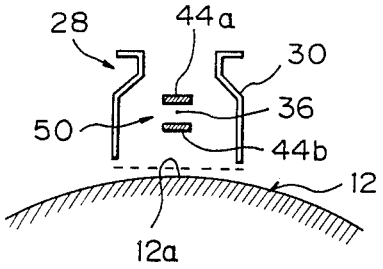
FIG. 5 is a schematic view for undestanding the principal of the present invention.
Figure 6:
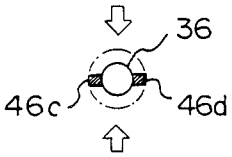
FIG. 6 is a schematic enlarged view associated with FIG. 5.

Specifically, FIG. 5 shows an embodiment of a wire cleaning device for a charger which is installed in an image recording apparatus to serve as any of the chargers previously stated. The cleaning device, gernerally 50, comprises a pair of parallel cleaner pads 44*a* and 44*b* which are respectively slidable on and along that portion of the wire 36 which faces the surface 12*a* of the photoconductive element 12 and a portion which is diametrically opposite to that portion. The cleaner pads 44*a* and 44*b* therefore are capable of fully removing impurities 46*c* and 46*d* from the above-mentioned portions of the wire 36 on which the cleaner pads 44*a* and 44*b* act, as indicated by arrows in FIG. 6.

Figure 7:
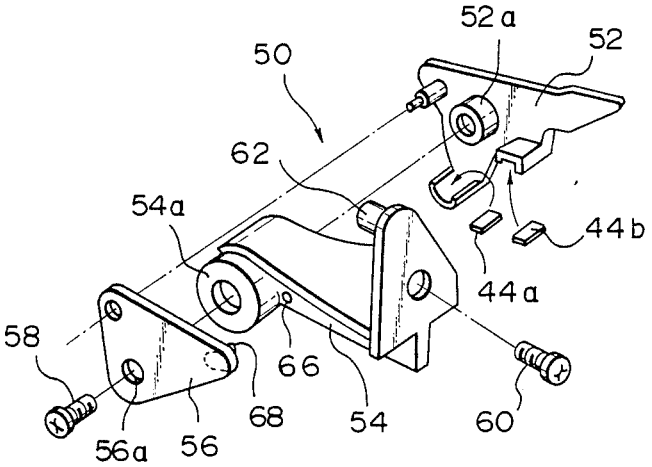
FIG. 7 is an exploded perspective view of a wire cleaning device embodying the present invention.
Figure 8:
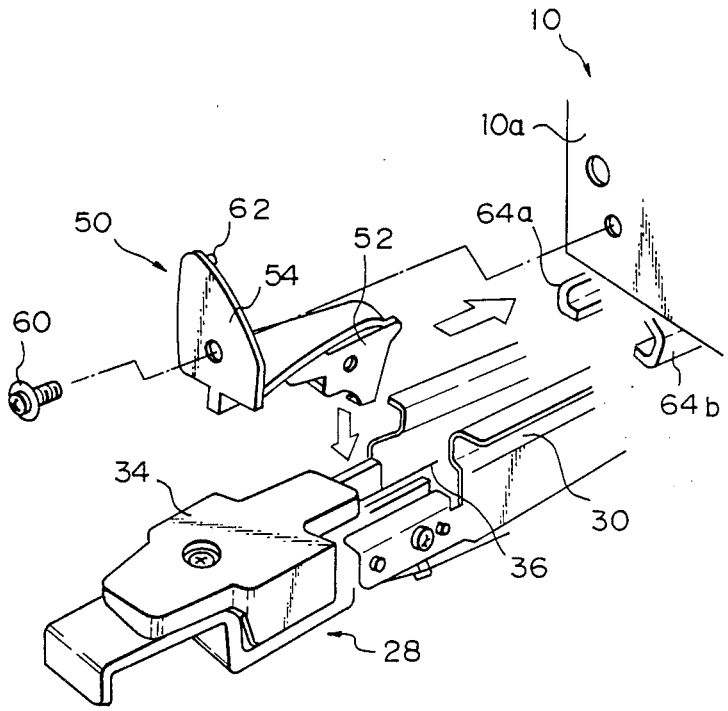
FIG. 8 shows the cleaning device of FIG. 7 in an assembled condition.

FIG. 7 shows a more specific construction of the wire cleaning device 50 while FIG. 8 shows how the device 50 is associated with the charger 28. As shown, the cleaning device 50 includes a cleaner holder 52 for holding the cleaner pads 44*a* and 44 *b*. A cleaner stay 54 is mounted on a framework 10*a* of the copier 10 and in turn supports the cleaner holder 52 such that the cleaner holder 52 is rotatable about a horizontal axis which is substantially perpendicular to the wire 36. A holder stopper 56 is provided for preventing the cleaner holder 52 which rotatably supported by a bearing portion 54*a* of the cleaner stay 54 from slipping out of the cleaner stay 54. Another function of the holder stopper 56 is maintaining the cleaner holder 52 in a predetermined position relative to the wire 36, as described in detail later. The cleaner holder 52 includes a stub 52*a* which is formed with a threaded bore and received in the bearing portion 54*a* of the cleaner stay 54. A screw 58 is driven into the threaded bore of the stub 52*a* via an opening 56*a* which is formed through the holder stopper 56, whereby the cleaner holder 52 is suported by the bearing portion 54*a* of the cleaner stay 54 in such a manner as to be rotatable about the stub 52*a* . The resulting cleaner assembly 50 is securely mounted to the framework 10*a* by a screw 60 and a projection 62 which extends from the cleaner stay 54. Guide rails 64*a* and 64*b* extend into the framework 10*a* from a position immediately below a position where the cleaning device 50 is mounted on the charger 28. The charger 28 whose wire 36 is to be cleaned by the cleaning device 50 is slidably mounted on the guide rails 64*a* and 64*b*.

The wire cleaning device 50 having the above construction is operated as follows.

Figure 9A:
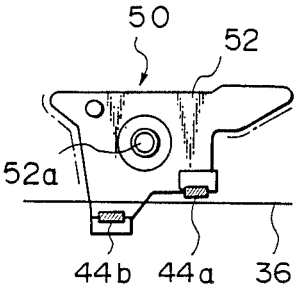
FIGS. 9A and 9B are views demonstrating the operation of the cleaning device shown in FIG. 7.
Figure 9B:
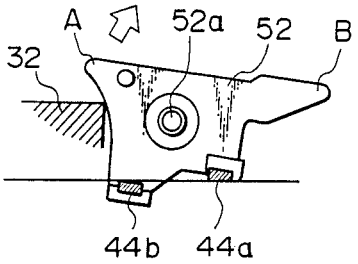
Figure 10A:
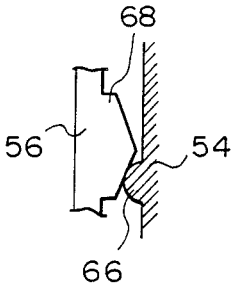
FIGS. 10A and 10B are views showing the operation of cleaning pads shown in FIG. 7.
Figure 10B:
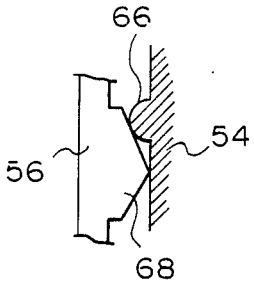
Figure 11:
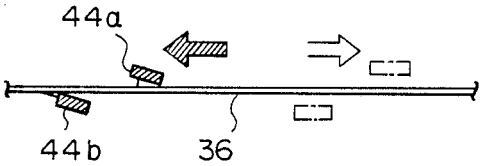
FIG. 11 is a schematic view showing how a wire is cleaned only in one direction in accordance with the present invention.

FIG. 9A shows a relationship between the cleaning device 50 and the wire 36 which holds when the charger 28 is loaded and unloaded. In the condition shown in FIG. 9A, the cleaner pads 44*a* and 44*b* are parallel to and spaced apart form the wire 36. The cleaner holder 52 is provided with cam A and B at opposite ends thereof with respect to the axial direction of the wire 36, as indicated by dash-and-dot lines in the figure. When the charger 28 is pulled out from the copier body until one end block 32 thereof abuts against the cam A of the cleaner holder 52, the cleaner holder 52 is rotated clockwise about the shaft 52*a* by a given angle resulting in the cleaning pads 44*a* and 44*b* abutting against the wire 36 from above and from below, repectively. As shown in FIG. 7, the clener stay 54 and the cleaner stopper 56 are respectively provided with lugs 66 and 68 which face each other. As shown in FIG. 10A, when the cleaning pads 44*a* and 44*b* are spaced apart from the wire 36, the lug 66 abuts against a lower portion of the lug 68. As the cleaning pads 44*a* and 44*b* are brought into contact with the wire 36 due to the rotation of the cleaner holder 52 as previously stated, the lug 66 abuts against an upper portion of the lug 68 by click motion and is therefore maintained in such a position. In this condition, when the charger 28 is pushed deeper into the copier body, the cleaning pads 44*a* and 44*b* clean the upper and lower portions of the wire 36 of the charger 28. As the other end block 34 of the charger 28 abuts against the other cam B of the cleaner holder 52 at the final stage of the insertion of the charger 28 into the copier body, the cleaner holder 52 is rotated counterclockwise to regain the position shown in FIG. 9A. Therefore, when the charger 28 is pulled out subsequently, the wire 36 is not cleaned by the cleaning pads 44*a* and 44*b* . In FIG. 11, a hatched arrow indicates a condition wherein the charger 28 is inserted into the copier body with the wire 36 being sequentially cleaned by the cleaning pads 44*a* and 44*b* while a blank arrow indicates a condition wherein the charger 28 is pulled out with the wire 36 being spaced apart from the cleaning pads 36 and therfore not cleaned. This prevents impurities collected at one end of the wire 36 while the charger 28 is inserted from being deposited again on the wire 36 while the charger 28 is pulled out.

In summary, the present invention provides a wire cleaning device for a corona discharge type charger which causes cleaning pads to act on a wire of the charger from above and below and therefore prevents the wire from yielding in any direction, promoting positive cleaning of that portion of the wire which faces the surface of a photoconductive element. This reliably frees a charger from the decrease in charging efficiency and irregular charging. Further, since the cleaning pads act on the wire only when they are moved in one direction relative to the wire, impurities collected at one end of the wire are preventing from being transferred again to the wire.

Various modifications will become possible for those skilled in the art after receiving the teachings of the present disclosure without departing form the scope thereof.

What is claimed is:

1. In a device for cleaning a wire of a charger having a shield case formed with an opening which faces a surface of a photoconductive element of an image recording apparatus to be charged and extends over substantially an entire length of the surface of said photoconductive element, and a wire extending within and in a lengthwise direction of said shield case, wherein the improvement comprises:

movable cleaning members movable into and out of contact with a portion of said wire which faces the surface of said photoconductive element and a portion which is diametrically opposite to said first-mentioned portion, respectively, and movable relative to said wire;

rotable support means for slidably engaging said cleaning members with said wire when said movable cleaning members are moved in one direction relative to said wire; and means for spacing apart said cleaning members from said wire when said movable cleaning members are moved in the other direction relative to said wire.

2. A device as claimed in claim 1, wherein said rotatable support means is rotatable about an axis which is substantially perpendicular to said wire.

3. A device as claimed in claim 1, wherein the movement of said movable cleaning members relative to the wire is caused by securely fastening said device to a body of said image recording apparatus and mounting and dismounting said charger from said body of said image recording apparatus.

4. A device as claimed in claim 1, which comprises means for moving said device in a lengthwise direction of said charger so as to move said cleaning members relative to said wire.

* * * * *